United States Patent [19]

Uchiyama

[11] 4,271,743

[45] Jun. 9, 1981

[54] ENVELOPE SIGNAL GENERATOR

[75] Inventor: Shigeru Uchiyama, Ageo, Japan

[73] Assignee: Kabushiki Kaisha Kawai Gakki Seisakusho, Hamamatsu, Japan

[21] Appl. No.: 94,633

[22] Filed: Nov. 15, 1979

[30] Foreign Application Priority Data

Nov. 17, 1978 [JP] Japan ..... 53-142044

[51] Int. Cl.[3] ..... G10H 1/057; G10H 1/22

[52] U.S. Cl. ..... 84/1.26; 84/1.13; 84/DIG. 2; 307/231; 328/137; 340/147 LP

[58] Field of Search ..... 84/1.1–1.13, 84/1.19, 1.21, 1.26, DIG. 2; 307/231; 328/137; 340/147 LP

[56] References Cited

U.S. PATENT DOCUMENTS 3,948,139 4/1976 Melcher et al. ..... 84/1.19

FOREIGN PATENT DOCUMENTS 52-124318 10/1977 Japan .

*Primary Examiner*—Stanley J. Witkowski

[57] ABSTRACT

An envelope signal generator which has a key depression/release signal generator for producing different output levels in response to key depression and key release, a switching circuit which is set to a first output level upon key depression and set to a second output level when the stored output level of an analog memory has reached a certain value, a preset circuit for outputting at least a level setting voltage and first and second time constant setting voltages relating to an envelope, a priority selector which is supplied with the key depression/release signal generator output, the switching circuit output and the level setting voltage and selects them in a predetermined order of priority, a first circuit for converting into a current the output from a voltage controlled amplifier supplied with the analog memory output and controlled by the first time constant setting voltage, a second circuit for converting into a current the output from a voltage controlled amplifier supplied with the analog memory output and controlled by the second time constant setting voltage, and an analog memory connected in common to the outputs of the first and second circuits, and in which the operative states of the first and second circuits are controlled in accordance with the output from the priority selector.

1 Claim, 10 Drawing Figures

FIG. 3A
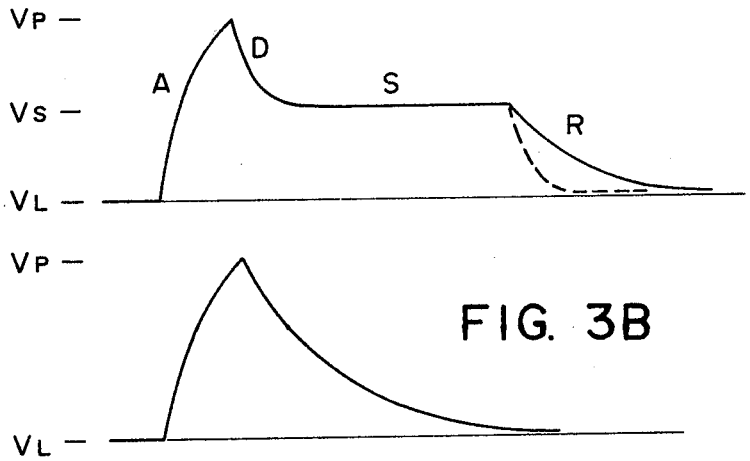
FIG. 3B
FIG. 4
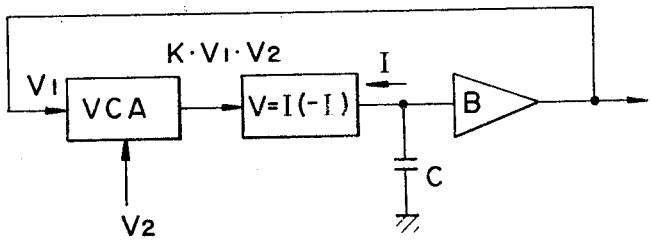

FIG. 5A
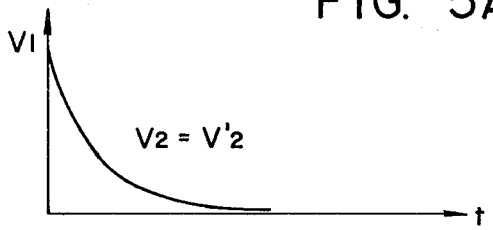
FIG. 5B
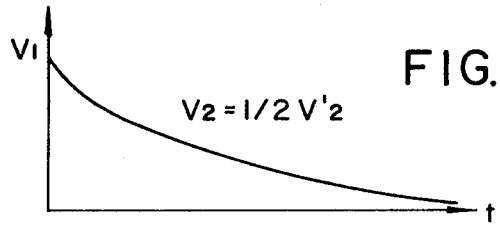
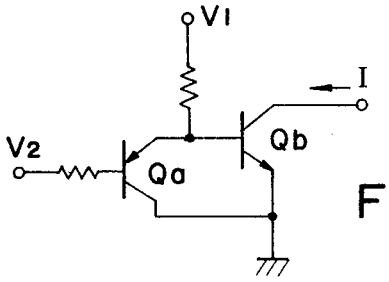
FIG. 6
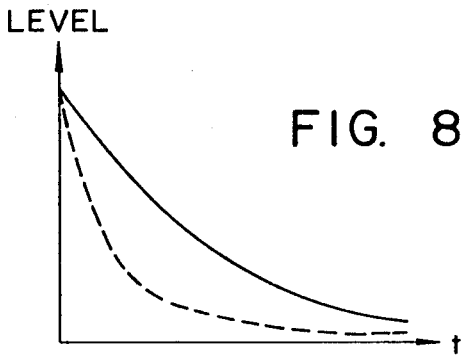
FIG. 8

ENVELOPE SIGNAL GENERATOR

BACKGROUND OF THE INVENTION

1. Field of the Invention

This invention relates to an envelope signal generator for electronic musical instruments, in particular, a preset type music synthesizer (hereinafter referred to as the preset type synthesizer).

2. Description of the Prior Art

An envelope signal generator heretofore employed for electronic musical instruments is such, for example, as proposed in Japanese Patent Application No. 40317/76 filed by the assignee of the present application and now Laid-Open Patent Publication No. 124318/1977. With this conventional circuit, various envelopes can be obtained by varying each of attack, decay, sustain and release parts forming an envelope by operating a variable resistor or the like in accordance with a certain voltage value; however, this circuit is not suitable for use with the preset type synthesizer and the like for the following reason. Namely, in the preset type synthesizer, it is necessary to switch an envelope characteristic to a desired one immediately when selecting the kind of a note by a change-over, so that the circuit of the type changing the envelope characteristic by a variable resistor is not suited. To meet such a requirement, there have also been proposed circuits which employ many combinations of numbers of resistors, diodes and change-over switches and perform switching of the envelope characteristic by actuating a selected one of the change-over switches, but their circuit constructions become more and more complicated.

In musical instruments such as a piano and so forth, the envelope generally differs for the pitch of each note, whereas in the synthesizer, a pitch determining voltage signal is produced in accordance with the pitch of each note. Accordingly, it would be more effective if the envelope could be controlled by that voltage signal according to the pitch. Further, if the envelope could be controlled by a voltage value, this would bring about the advantage that remote control of the envelope signal generator can be achieved by connecting it with other devices.

SUMMARY OF THE INVENTION

An object of this invention is to provide an envelope signal generator which permits changing of an envelope signal waveshape in accordance with set voltage values.

The above object can be achieved by providing an envelope signal generator which comprises a key depression/release signal generator for producing different output levels in response to key depression and key release, a switching circuit which is set to a first output level upon key depression and set to a second output level when the stored output level of an analog memory has reached a certain value, a preset circuit for outputting at least a level setting voltage and first and second time constant setting voltages relating to an envelope, a priority selector which is supplied with the key depression/release signal generator output, the switching circuit output and the level setting voltage and selects them in a predetermined order of priority, a first circuit for converting into a current the output from a voltage controlled amplifier supplied with the analog memory output and controlled by the first time constant setting voltage, a second circuit for converting into a current the output from a voltage controlled amplifier supplied with the analog memory output and controlled by the second time constant setting voltage, and an analog memory connected in common to the outputs of the first and second circuits, and wherein the operative state of the first and second circuits is controlled in accordance with the output from the priority selector.

BRIEF DESCRIPTION OF THE DRAWINGS

FIGS. 3(A) and 3(B) show envelope waveshapes produced according to this invention;

FIGS. 4, 5(A) and 5(B) are a block diagram showing the construction of the principal part of the embodiment of FIG. 2 and graphs explanatory of its operation;

FIG. 6 is a circuit diagram showing a specific operative example of the circuit depicted in FIG. 4;

FIG. 8 is a graph explanatory of the characteristic of the embodiment of this invention.

DESCRIPTION OF THE PREFERRED EMBODIMENTS

Figure 1:
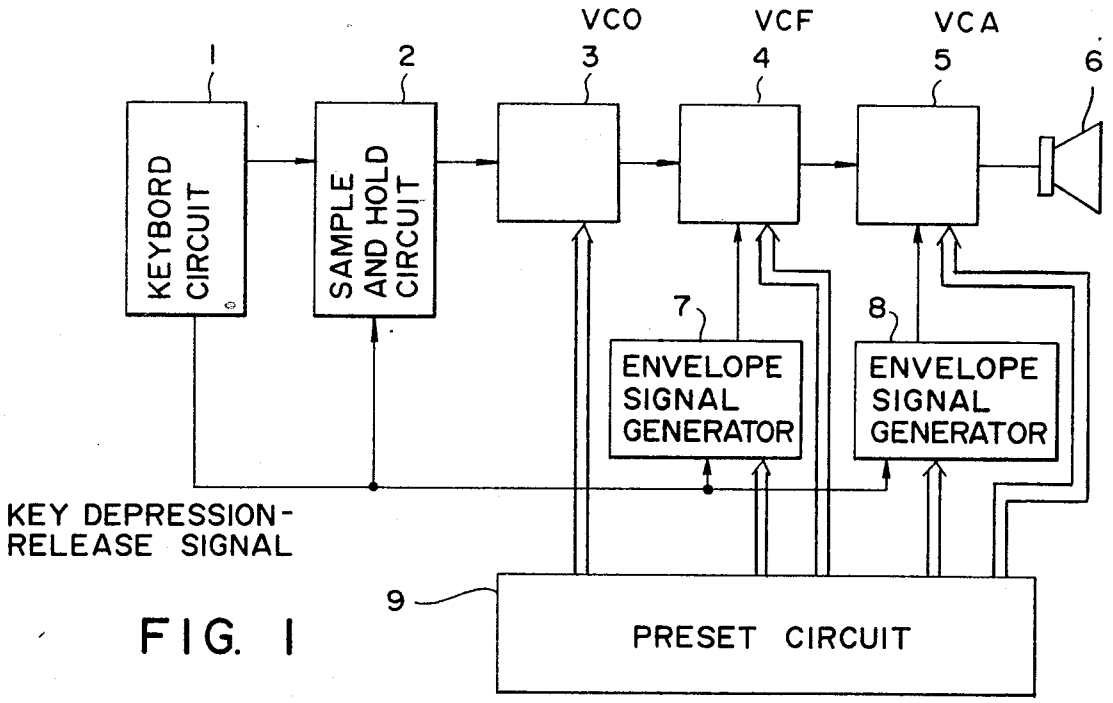
FIG. 1 is a block diagram explanatory of the preset type synthesizer to which this invention is applied.

In FIG. 1 showing in block form a preset synthesizer to which the present invention is applied, a keyboard circuit 1 produces a pitch determining voltage signal corresponding to a key depressed and a key depression/release signal representing a key depressed or released state. The pitch determining voltage signal from the keyboard circuit 1 is stored in a sample and hold circuit 2, and by a voltage controlled oscillator (VCO)3, a signal is produced whose frequency corresponds to the pitch determining voltage signal. The frequency signal from the voltage controlled oscillator (VCO)3 is tone controlled by a voltage controlled filter (VCF)4, and the tone signal thus obtained from the voltage controlled filter (VCF)4 is amplitude modulated by a voltage controlled amplifier (VCA)5. Envelope signal generators 7 and 8 are circuits which are provided according to the present invention and which generate envelope signals corresponding to the key depression/release signal from the keyboard circuit 1 and preset signals from a preset circuit 9 to control the voltage controlled filter 4 and the voltage controlled amplifier 5, respectively. The preset circuit 9 has preset therein desired tones and provides voltage values corresponding thereto for controlling the voltage controlled oscillator (VCO)3, the voltage controlled filter (VCF)4, the voltage controlled amplifier (VCA)5 and the envelope signal generators 7 and 8.

Figure 2:
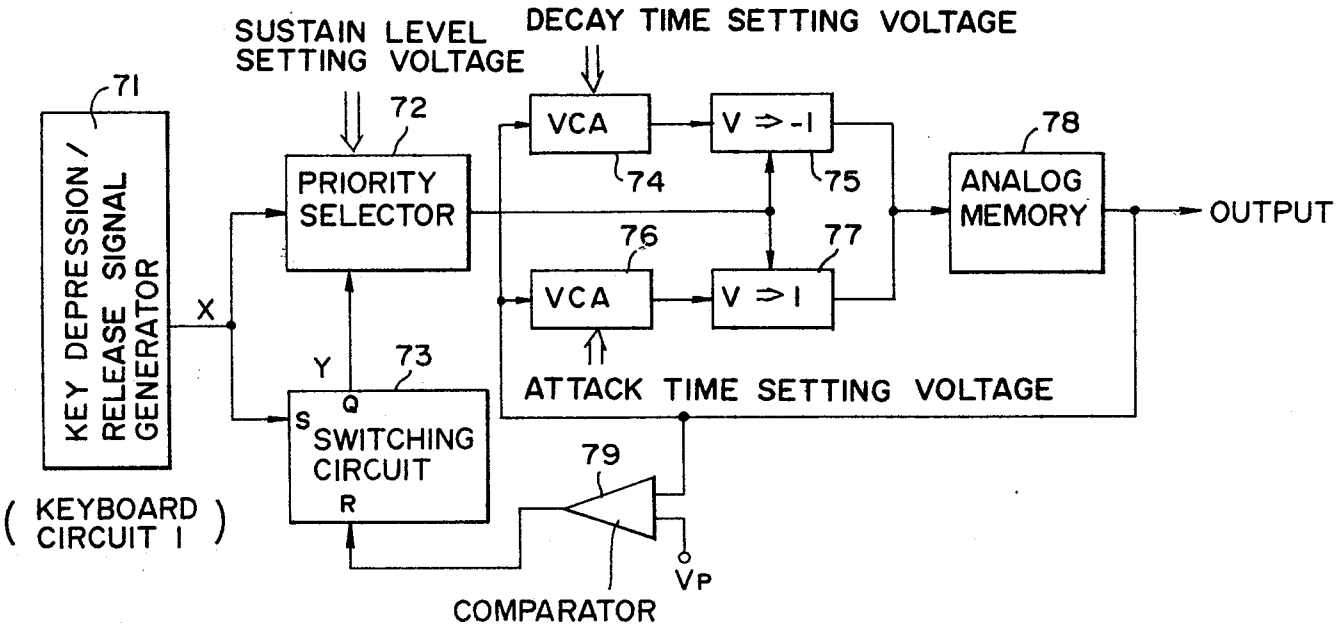
FIG. 2 is a block diagram illustrating an embodiment of the envelope signal generator of this invention.

In FIG. 2 which is explanatory of an embodiment of the envelope signal generator of this invention, a key depression/release signal generator 71 is provided in the keyboard circuit 1 in FIG. 1 for producing a key depression/release signal corresponding to key depression or release. By the rise-up of the key depression/release signal, a switching circuit 73 formed by a flip-flop is put in its set state, causing its output Q to be Vh. A priority selector 72 receives the key depression/release signal, the output Q from the switching circuit 73 and a sustain level setting voltage from the preset circuit 9 and select them in this order. Namely, the inputs and outputs of the priority selector 72 bear the relationships such as shown below in Table 1.

| Key depression/ release signal | Switching circuit output | Sustain level setting voltage | Priority selector output |
|---|---|---|---|
| $V_L$(release key) | Vl (Q = 0) | Vs | $V_L$ |
| $V_H$(depression key) | Vh (Q = 1) | Vs | Vh |
| $V_H$(depression key) | Vl | Vs | Vs |

During key depression, the key depression/release signal is $V_H$, and the output from the switching circuit 73 is Vh, so that the output from the priority selector 72 is Vh as shown in Table 1. At this time, a voltage-to-current (V→I) converter 77 is in its operative state, and an analog memory 78, which is formed by a capacitor, is charged by a voltage controlled amplifier 76 and the voltage-to-current converter 77. The time constant for this charging is determined by an attack time setting voltage of the preset circuit 9; this charge time constant corresponds to an attack part A of an envelope waveshape shown in FIG. 3(A). When the voltage of the analog memory 78 exceeds a certain value, a comparator 79 is inverted to reset the switching circuit 73, causing its output to be Vl. At this time, the keyboard circuit 1 is still in the key depressed state, so that the key depression/release signal is $V_H$, and the output from the priority selector 72 becomes such a sustain level setting voltage Vs as shown in Table 1. In this case, a voltage-to current (V→−I) converter 75 becomes operative and the voltage-to-current (V→I) converter 77 becomes inoperative, and by the voltage controlled amplifier 74 and the voltage-current converter 75, the analog memory 78 is discharged. The time constant for this discharge is determined by a decay time setting voltage of the preset circuit 9; this discharge time constant corresponds to a decay part D of the envelope waveshape shown in FIG. 3(A). Next, when the voltage value of the analog memory 78 becomes Vs, the voltage-current converter 75 is rendered inoperative, and the analog memory 78 remains at Vs. This state corresponds to a sustain part S of the envelope waveshape of FIG. 3(A). Then, upon release of a key, the key depression/release signal generator 71 produces an output $V_L$, so that the output from the priority selector 72 becomes $V_L$, as shown in Table 1, and the voltage-current converter 75 becomes operative again, causing the analog memory 78 to resume discharging. The time constant in this case is also determined by the decay time setting voltage of the preset circuit 9; this time constant corresponds to a release part R of the envelope waveshape of FIG. 3(A).

The general operation of this invention is as described above. Referring now to FIGS. 4, 5(A) and 5(B), a detailed description will be given of the charge or discharge operation of the circuit comprising the voltage controlled amplifier 74, the voltage-current converter 75 and the analog memory 78 or the circuit comprising the voltage controlled amplifier 76, the voltage-current converter 77 and the analog memory 78.

In FIG. 4, the abovesaid circuit is shown without any reference numeral, and the analog memory 78 is shown equivalently by a parallel capacitor C and an amplifier B. The voltage of the capacitor C is fed back to the input of the voltage controlled amplifier (VCA), wherein the feedback voltage $V_1$ is controlled by a control voltage $V_2$, that is, the setting voltage of the preset circuit, providing an output voltage $K \cdot V_1 \cdot V_2$. By converting this output voltage into a corresponding current by the voltage-current converter (V→I), the capacitor C is discharged. In this case, the output from the voltage-current converter (V→I) is as follows:

$$I = K_1 \cdot V_1 \cdot V_2 \tag{1}$$

where $K_1$ is a constant. Considering a very short discharge time, it follows from $-dV_1 = (dQ)/C = (Idt)/C$ that $$\begin{aligned} &\frac{K_1 \cdot V_1 \cdot V_2 \cdot dt}{C} = -dV_1 \\ &\frac{1}{V_1}\frac{dV_1}{dt} = \frac{-K_1 V_2}{C} = -K_2 \cdot V_2 \\ &\int \frac{1}{V_1}\frac{dV_1}{dt}\,dt = -\int K_2 V_2 dt \\ &\log V_1 = -K_3 \cdot V_2 \cdot t \\ &V_1 = e^{-K_3 \cdot V_2 \cdot t} \end{aligned} \tag{2}$$

where $K_2$ and $K_3$ are constants. It is evident that the time constant of the voltage $V_1$ is dependent on the voltage $V_2$. Assuming that the voltage $V_1$ has a characteristic such, for example, as shown in FIG. 5(A) at an arbitrary decay time setting voltage $V_2$ of the voltage $V_2'$, the voltage $V_1$ presents such a characteristic as depicted in FIg. 5(B) when the setting voltage is reduced to ½. Thus, a variable waveshape can be obtained by the setting of the voltage $V_2$.

FIG. 6 illustrates specific operative examples of the voltage controlled amplifier and the voltage-current (V→I(−I)) converter in FIG. 4. In FIG. 6, the emitter and collector of a PNP transistor Qa are respectively connected to the base and emitter of an NPN transistor Qb, and the voltages $V_1$ and $V_2$ are respectively applied as an emitter and a base bias of the transistor Qa, and the emitter of the transistor Qb is grounded to output a current I from the collector thereof, by which the operation of the voltage controlled amplifier and the voltage-current (V→I(−I)) conversion can be performed at the same time. The collector current I of the transistor Qb in this case is given as follows:

$$I = K_1' \cdot V_1 \cdot K_2' V_2 \tag{3}$$

where $K_1'$ and $K_2'$ are constants. A change in the voltage $V_1$ with time is given as follows:

$$V_1 = e^{-\frac{K_1'}{C_1} \cdot K_2' V_2 \cdot t} \tag{4}$$

As is seen from the expressions (3) and (4), the output $V_1$ from the analog memory 78 varies in waveshape in dependence on the voltage $V_2$, that is, the setting voltage from the preset circuit 9.

Figure 7:
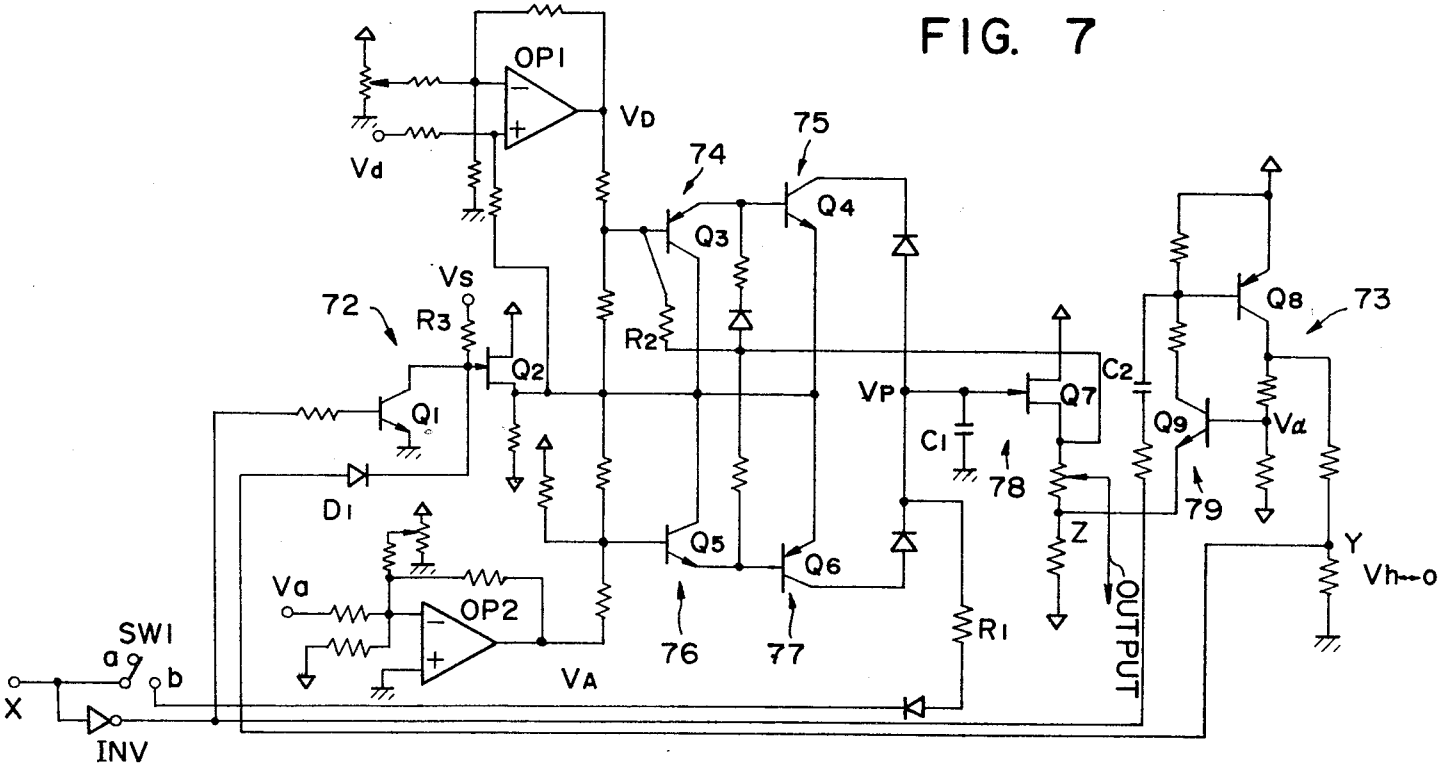
FIG. 7 is a diagram illustrating a specific operative circuit arrangement of the embodiment shown in FIG. 2.

FIG. 7 illustrates a specific operative example of the embodiment of FIG. 2. In FIG. 7, the key depression/release signal is inputted via a terminal X. This signal is inverted by an inverter INV and differentiated by a capacitor $C_2$ for input to a switching circuit 73 composed of transistors $Q_8$ and $Q_9$, and at this time, the transistor $Q_8$ is turned ON. As a consequence, a bias is also applied to the base of the transistor $Q_9$ to turn it ON, and the potential at a voltage dividing point Y, which is derived from the collector of the transistor $Q_8$, varies from 0 V (Vl) to Vh. The priority selector 72 is composed of a transistor $Q_1$ and a field effect transistor (FET)$Q_2$; during key depression, 0 V is inputted to the base of the transistor $Q_1$, so that the transistor $Q_1$ remains in its OFF state and its output voltage is $V_H$. This output is provided to the gate of the field effect transistor $Q_2$, and this gate is supplied with the aforesaid potential at the point Y of the switching circuit 73 via a diode $D_1$ and a sustain level setting voltage Vs via a high resistance $R_3$. As a result of this, the field effect transistor $Q_2$ provides a voltage Vh at its output. At this time, since the potential of a capacitor $C_1$ forming the analog memory 78 is 0 V, transistors $Q_5$ and $Q_6$ forming the voltage controlled amplifier 76 and the voltage-current converter 77 are rendered operative. By the collector current of the transistor $Q_6$, the capacitor $C_1$ is charged to raise its output level. In this case, letting the output voltage from an operational amplifier OP2 supplied with the attack time setting voltage Va to be represented by $V_A$, the charge time constant is dependent on $V_A$-Vh. This state corresponds to the attack part A of the envelope waveshape shown in FIG. 3(A).

When the capacitor $C_1$ forming the analog memory 78 is charged and the potential at a point Z of the source of a buffer field effect transistor (FET)$Q_7$ exceeds the base potential $V\alpha$ of the transistor $Q_9$ of the comparator 79, if the voltage of the capacitor $C_1$ becomes Vp, the transistor $Q_9$ of the comparator 79 is turned OFF and the transistor $Q_8$ is also turned OFF, resulting in the potential at the point Y varying from Vh to 0 V (Vl). As a consequence, the diode $D_1$ is cut off to cause the output from the priority selector 72 to become the preset sustain level voltage Vs. Since $Vp \geqq Vs$, the transistors $Q_5$ and $Q_6$ become inoperative, but instead the transistors $Q_3$ and $Q_4$ constituting the voltage controlled amplifier 74 and the voltage-current converter 75, respectively, are rendered operative. Therefore, charges of the capacitor $C_1$ are discharged until its voltage Vp becomes equal to the sustain level voltage Vs. In this instance, letting the output voltage from an operational amplifier OP1 supplied with the decay time setting voltage Vd be represented by $V_D$, the time constant of the above discharge is dependent on $V_D$-Vs. This state corresponds to the decay part D of the envelope waveshape depicted in FIG. 3(A).

After the potential Vp of the capacitor $C_1$ has reached the sustain level voltage Vs, the transistors $Q_3$ to $Q_6$ are all held inoperative, so that the voltage of the capacitor $C_1$ is retained at the sustain level voltage Vs. This state corresponds to the sustain part S of the envelope waveshape shown in FIG. 3(A).

Upon releasing the key, the transistor $Q_1$ of the priority selector 72 is turned ON to cause the output from the field effect transistor $Q_2$ to become 0 V (Vl), putting again the transistors $Q_3$ and $Q_4$ in the operative state. As a result of this, the voltage of the capacitor $C_1$ is discharged until the voltage Vs becomes 0 V. The time constant of this discharge is determined by $V_D$. This state corresponds to the release part R of the envelope waveshape shown in FIG. 3(A).

In this case, by changing over a switch (SW)1 to a contact b, the charges of the capacitor $C_1$ can also be discharged rapidly only through a resistor $R_1$ upon releasing of the key. This state is indicated by the broken line in FIG. 3(A).

Further, by providing a resistor $R_2$ between the base of the transistor $Q_3$ of the voltage controlled amplifier 74 and the source of the buffer $Q_7$ of the analog memory 78, the curve of the discharge in the decay part D can be modified as indicated by the broken line in FIG. 8, by which the resulting musical note can be made closer to a musical sound produced by an actual musical instrument.

Moreover, the envelope waveshape can be modified, as shown in FIG. 3(B), by setting the sustain level voltage Vs at 0 V.

As has been described in the foregoing, according to this invention, the attack, decay, sustain and release parts forming the envelope signal can each be controlled as a voltage value unlike in the prior art; therefore, the envelope signal generator of this invention can effectively be applied to the preset type synthesizer. Further, since the abovesaid parts can also be controlled by a pitch determining voltage signal, the resulting note can be made close to a musical sound produced by an actual musical instrument. In addition, the envelope signal generator can also be controlled remotely in combination with other devices.

It will be apparent that many modifications and variations may be effected without departing from the scope of the novel concepts of this invention.

What is claimed is:

1. An envelope signal generator comprising:

a key depression/release signal generator for producing different output levels in response to key depression and key release;

an analog memory;

a switching circuit which is set to a first output level upon key depression and set to a second output level when the stored output level of said analog memory has reached a certain value;

a preset circuit for outputting at least a level setting voltage and first and second time constant setting voltages relating to an envelope;

a priority selector which is supplied with the key depression/release signal generator output, the switching circuit output and the level setting voltage and selects one of them in a predetermined order of priority;

first and second voltage controlled amplifiers;

a first circuit for converting into a current the output from said first voltage controlled amplifier supplied with the output from said analog memory and controlled by the first time constant setting voltage;

a second circuit for converting into a current the output from said second voltage controlled amplifier supplied with the output from said analog memory and controlled by the second time constant setting voltage; and wherein said analog memory is connected in common to the outputs of the first and second circuits;

wherein the operative states of the first and second circuits are controlled in accordance with the output from the priority selector.

* * * * *